US010481547B2

(12) United States Patent
Murauchi et al.

(10) Patent No.: US 10,481,547 B2
(45) Date of Patent: Nov. 19, 2019

(54) CLEANING DEVICE AND IMAGE FORMING APPARATUS INCLUDING THE SAME

(71) Applicant: Konica Minolta, Inc., Tokyo (JP)

(72) Inventors: Junji Murauchi, Aichi (JP); Noritoshi Hagimoto, Aichi (JP); Yoshiki Nakane, Aichi (JP); Takuya Okada, Aichi (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/459,070

(22) Filed: Mar. 15, 2017

(65) Prior Publication Data

US 2017/0269538 A1 Sep. 21, 2017

(30) Foreign Application Priority Data

Mar. 18, 2016 (JP) ..... 2016-055408

(51) Int. Cl.
*G03G 21/00* (2006.01)

(52) U.S. Cl.
CPC ..... *G03G 21/0011* (2013.01); *G03G 21/0029* (2013.01); *G03G 2215/0132* (2013.01)

(58) Field of Classification Search
CPC ..... G03G 21/0011
See application file for complete search history.

(56) References Cited

U.S. PATENT DOCUMENTS 4,639,123 A * 1/1987 Adachi ..... G03G 21/0011 15/256.51
4,730,205 A * 3/1988 Ogiri ..... G03G 21/12 399/35
5,608,509 A * 3/1997 Shirai ..... G03G 21/0011 399/351
5,991,568 A * 11/1999 Ziegelmuller ..... G03G 21/007 399/102
7,873,314 B2 1/2011 Sakanobe et al.
(Continued)

FOREIGN PATENT DOCUMENTS

JP 2002055579 A * 2/2002
JP 2008-102322 A 5/2008
(Continued)

OTHER PUBLICATIONS

Notice of Reasons for Refusal issued in corresponding Japanese Patent Application No. 2016-055408, dated Aug. 6, 2019, with translation (14 pages).
(Continued)

*Primary Examiner* — Walter L Lindsay, Jr.
*Assistant Examiner* — Arlene Heredia
(74) *Attorney, Agent, or Firm* — Osha Liang LLP

(57) ABSTRACT

A cleaning device scrapes off and removes toner that has adhered to a surface of a rotating photoreceptor, and includes: a cleaning member formed of an elastic body; a leaf spring member for pressing the cleaning member against the surface of the photoreceptor; and a support portion supporting the leaf spring member. The cleaning member is fixed to one end of the leaf spring member, and the other end of the leaf spring member is fixed to the support portion with a cushioning member formed of an elastic body interposed therebetween. The cushioning member is fixed to the other end of the leaf spring member by an adhesive.

6 Claims, 8 Drawing Sheets

(56) References Cited

U.S. PATENT DOCUMENTS

| | | | | |
|---|---|---|---|---|
| 2004/0134757 | A1* | 7/2004 | DeVries | B65G 45/16 198/497 |
| 2006/0216084 | A1* | 9/2006 | Kojima | G03G 21/0017 399/350 |
| 2010/0054831 | A1 | 3/2010 | Sakanobe et al. | |

FOREIGN PATENT DOCUMENTS

| | | | |
|---|---|---|---|
| JP | 2008-122683 | A | 5/2008 |
| JP | 2010-060742 | A | 3/2010 |
| JP | 2010-060860 | A | 3/2010 |

OTHER PUBLICATIONS

Office Action issued in corresponding Chinese Patent Application No. 201710160154.0, dated Sep. 3, 2019, with translation (14 pages).

* cited by examiner

FIG.9

| | CLEANING MEMBER | | CUSHIONING MEMBER | | | | LEAF SPRING MEMBER | EVALUATION RESULT |
|---|---|---|---|---|---|---|---|---|
| | THICKNESS T1 [mm] | LENGTH L1 [mm] | THICKNESS T2 [mm] | LENGTH L2 [mm] | ASKER C HARDNESS [DEGREE] | SURFACE OF ATTACHMENT | DESIGN FREE LENGTH L0 [mm] | |
| EXAMPLE 1 | 2.0 | 6.0 | 2.0 | 5.0 | 70 | OPPOSITE TO CLEANING MEMBER | 14.0 | GOOD |
| EXAMPLE 2 | 2.0 | 6.0 | 2.0 | 5.0 | 70 | SAME AS CLEANING MEMBER | 14.0 | GOOD |
| EXAMPLE 3 | 2.0 | 6.0 | 2.0 | 5.0 | 50 | OPPOSITE TO CLEANING MEMBER | 14.0 | GOOD |
| EXAMPLE 4 | 2.0 | 6.0 | 2.0 | 5.0 | 80 | OPPOSITE TO CLEANING MEMBER | 14.0 | GOOD |
| EXAMPLE 5 | 2.0 | 6.0 | 1.5 | 5.0 | 80 | OPPOSITE TO CLEANING MEMBER | 14.0 | GOOD |
| EXAMPLE 6 | 2.0 | 6.0 | 2.0 | 4.0 | 70 | OPPOSITE TO CLEANING MEMBER | 14.0 | GOOD |
| EXAMPLE 7 | 2.0 | 6.0 | 2.0 | 3.0 | 70 | OPPOSITE TO CLEANING MEMBER | 14.0 | GOOD |
| EXAMPLE 8 | 1.5 | 6.0 | 2.0 | 5.0 | 70 | OPPOSITE TO CLEANING MEMBER | 12.0 | GOOD |
| COMPARATIVE EXAMPLE 1 | 2.0 | 6.0 | – | – | – | – | 14.0 | DISAPPROVED |
| COMPARATIVE EXAMPLE 2 | 2.0 | 6.0 | – | – | – | – | 14.0 | DISAPPROVED |

CLEANING DEVICE AND IMAGE FORMING APPARATUS INCLUDING THE SAME

This application is based on Japanese Patent Application No. 2016-055408 filed with the Japan Patent Office on Mar. 18, 2016, the entire content of which is hereby incorporated by reference.

BACKGROUND OF THE INVENTION

Field of the Invention

The present invention relates to a cleaning device for scraping off and removing toner that has adhered to the surface of a rotating photoreceptor, and an image forming apparatus including the cleaning device.

Description of the Related Art

Examples of known cleaning devices for scraping off and removing residual toner that has adhered to the surface of a photoreceptor provided in an image forming apparatus include a cleaning device utilizing a rubber blade entirely made of a rubber material. In a situation where a cleaning device utilizing this rubber blade is used, a contact pressure of the rubber blade with the photoreceptor needs to be set at a level considerably higher than that of a contact pressure originally needed.

This is because it is necessary to take into account a reduction in the contact pressure over time resulting from permanent deformation of the rubber material forming the rubber blade and from chipping of the rubber blade after a long period of use, variation in thickness of the rubber blade, variation in free length of the rubber blade, and the like.

However, when a higher contact pressure of the rubber blade is set with the photoreceptor as described above, a photoreceptor film formed on the surface of the photoreceptor is subjected to abrasion quickly, resulting in a greatly shortened life of the photoreceptor.

Thus, a cleaning device utilizing a so-called tip blade has been widely used, which is formed by affixing a cleaning member made of a rubber material to the tip of a leaf spring member made of metal. In a situation where a cleaning device utilizing this tip blade is used, the permanent deformation of the rubber material is reduced and dimensional accuracy of the tip blade as a whole is improved, thus allowing a great reduction in the contact pressure of the tip blade with the photoreceptor, to provide for a longer life of the photoreceptor.

Examples of documents disclosing a cleaning device utilizing this tip blade include Japanese Laid-Open Patent Publication Nos. 2008-102322, 2008-122683, 2010-60742 and 2010-60860.

However, using a cleaning device utilizing a tip blade causes the contact pressure with the photoreceptor to vary widely depending on the location in an axial direction of the photoreceptor, as compared to a situation where a cleaning device utilizing a rubber blade is used. This is because, in contrast to a rubber blade, a tip blade includes a leaf spring member made of metal in a portion thereof, and depending on a bonding state between this leaf spring member and a support portion supporting this leaf spring member, the actual free length of the tip blade varies depending on the location in the axial direction of the photoreceptor.

If the tip blade is fixed to the support portion using screws, for example, it is inevitable that the contact pressure of the tip blade with the support portion will be distributed non-uniformly, causing the actual free length of the tip blade to vary depending on the location in the axial direction of the photoreceptor. If the tip blade is fixed to the support portion using an adhesive, it is inevitable that the adhesive layer between the tip blade and the support portion will have a non-uniform thickness, causing the actual free length of the tip blade to vary depending on the location in the axial direction of the photoreceptor.

If the contact pressure with the photoreceptor varies depending on the location in the axial direction of the photoreceptor, abrasion of the photoreceptor film also varies depending on the location over time, resulting in a reduction in quality of a formed image. If this contact pressure variation can be suppressed, the contact pressure of the tip blade with the photoreceptor can be set at a lower level, thus providing for a longer life of the photoreceptor.

SUMMARY OF THE INVENTION

One or more embodiments of the invention provide a cleaning device capable of suppressing the occurrence of abrasion variation in a photoreceptor film, and an image forming apparatus including the cleaning device.

A cleaning device according to one or more embodiments scrapes off and removes toner that has adhered to a surface of a rotating photoreceptor, and includes: a cleaning member formed of an elastic body; a leaf spring member for pressing the cleaning member against the surface of the photoreceptor; and a support portion supporting the leaf spring member. The cleaning member is fixed to one end of the leaf spring member, and the other end of the leaf spring member is fixed to the support portion with a cushioning member formed of an elastic body interposed therebetween. The cushioning member is fixed to the other end of the leaf spring member by an adhesive.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 9 is a table showing test conditions and test results of a second verification test.

DESCRIPTION OF THE EMBODIMENTS

Figure 1:
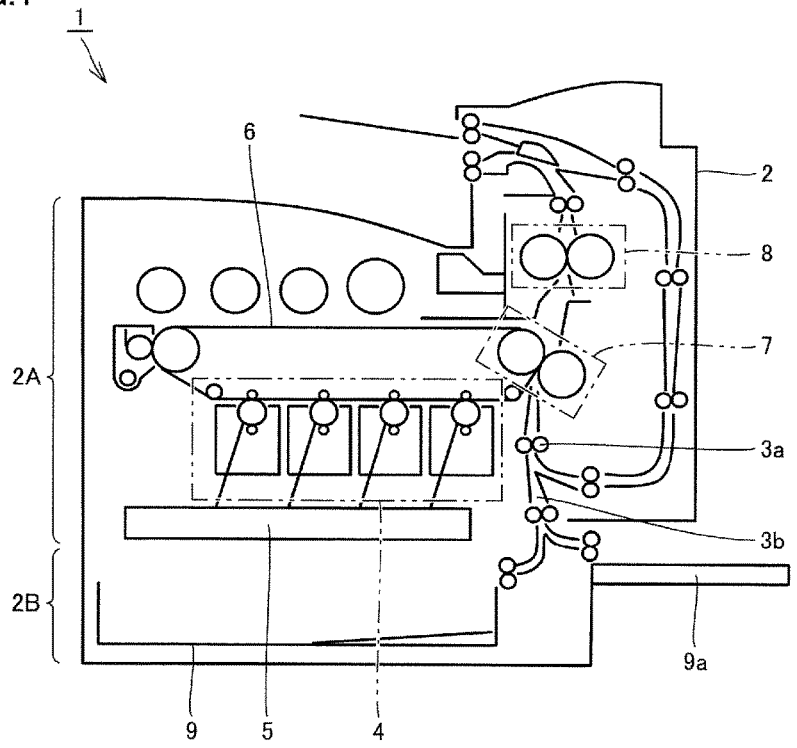
FIG. 1 is a schematic diagram of an image forming apparatus according to one or more embodiments of the present invention.

Embodiments of the present invention will be described below in detail with reference to the drawings. The following illustrates and describes, as an image forming apparatus and a cleaning device to which one or more embodiments of the present invention are applied, a so-called tandem type color printer based on electrophotography and a cleaning device provided therein. It is noted that in the following, the same or common parts are designated by the same reference characters in the drawings and description thereof will not be repeated.

Figure 2:
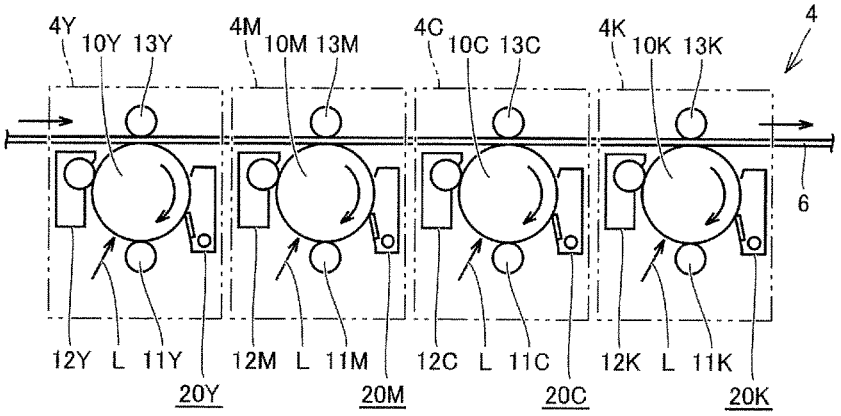
FIG. 2 is a schematic diagram of an image forming part shown in FIG. 1.

FIG. 1 is a schematic diagram of an image forming apparatus according to one or more embodiments of the present invention, and FIG. 2 is a schematic diagram of an image forming part shown in FIG. 1. First, referring to these FIGS. 1 and 2, a schematic configuration of an image forming apparatus 1 will be described.

As shown in FIG. 1, image forming apparatus 1 mainly includes an apparatus body 2 and a paper feed unit 9. Apparatus body 2 includes an image forming part 2A for forming an image on a sheet of paper, and a paper feed part 2B for feeding sheets of paper to image forming part 2A. Paper feed unit 9 contains sheets of paper to be fed to image forming part 2A, and is removably provided in paper feed part 2B.

In image forming apparatus 1, various types of rollers 3*a* are placed across the aforementioned image forming part 2A and paper feed part 2B, to thereby create a conveyance path 3*b* along which the sheets of paper are conveyed along a prescribed direction. In addition, as shown in the figure, paper feed part 2B may be separately provided with a manual paper feed tray 9*a* for feeding sheets of paper to image forming part 2A.

Image forming part 2A mainly includes an image forming part 4 capable of forming a toner image of each color, an exposure unit 5 for exposing photoreceptor drums 10Y, 10M, 10C and 10K (see FIG. 2) included in image forming part 4 and configured to be able to rotate, an intermediate transfer belt 6 suspended on image forming part 4, a transfer part 7 provided on conveyance path 3*b* and on a track of intermediate transfer belt 6, and a fixing part 8 provided on conveyance path 3*b* in a portion downstream of transfer part 7.

As shown in FIG. 2, image forming part 4 has image forming units 4Y, 4M, 4C and 4K that form toner images of yellow (Y), magenta (M), cyan (C) and black (K).

Image forming units 4Y, 4M, 4C and 4K include photoreceptor drums 10Y, 10M, 10C and 10K, respectively. Image forming units 4Y, 4M, 4C and 4K further include charging rollers 11Y, 11M, 11C and 11K, developing devices 12Y, 12M, 12C and 12K, transfer rollers 13Y, 13M, 13C and 13K, and cleaning devices 20Y, 20M, 20C and 20K, respectively, which are arranged around these photoreceptor drums 10Y, 10M, 10C and 10K successively from the upstream side along a rotation direction of the photoreceptor drums, respectively.

The aforementioned intermediate transfer belt 6 is inserted between photoreceptor drums 10Y, 10M, 10C, 10K and transfer rollers 13Y, 13M, 13C, 13K, respectively, and is in contact with each of photoreceptor drums 10Y, 10M, 10C and 10K at that inserted portion.

In forming a toner image, first, the surfaces of photoreceptor drums 10Y, 10M, 10C and 10K are charged by charging rollers 11Y, 11M, 11C and 11K, respectively.

Next, the surfaces of photoreceptor drums 10Y, 10M, 10C and 10K are irradiated with exposure light L by exposure unit 5, whereby an electrostatic latent image is written to each of the surfaces of photoreceptor drums 10Y, 10M, 10C and 10K.

Next, toners of the corresponding colors are supplied to the surfaces of photoreceptor drums 10Y, 10M, 10C and 10K by developing devices 12Y, 12M, 12C and 12K, respectively, whereby a toner image corresponding to the electrostatic latent image is formed on each of the surfaces of photoreceptor drums 10Y, 10M, 10C and 10K.

The toner images formed on the surfaces of photoreceptor drums 10Y, 10M, 10C and 10K are then transferred to intermediate transfer belt 6 by transfer rollers 13Y, 13M, 13C and 13K, respectively (so-called primary transfer).

Then, the toner remaining on the surfaces of photoreceptor drums 10Y, 10M, 10C and 10K is scraped off and removed by cleaning devices 20Y, 20M, 20C and 20K, respectively.

Consequently, the toner image of each color is superposed on the surface of intermediate transfer belt 6 by image forming units 4Y, 4M, 4C and 4K, whereby a color toner image is formed. It is noted that a monochrome toner image is formed on the surface of intermediate transfer belt 6 when only image forming unit 4K is used.

Intermediate transfer belt 6 transports the color toner image or monochrome toner image formed on its surface to transfer part 7, and is pressed, by a pair of transfer rollers at transfer part 7, against a sheet of paper conveyed to transfer part 7 from paper feed part 2B. Consequently, the color toner image or monochrome toner image formed on the surface of intermediate transfer belt 6 is transferred to the sheet of paper (so-called secondary transfer).

The sheet of paper to which the color toner image or monochrome toner image has been transferred is then pressurized and heated by fixing part 8. Consequently, the color image or monochrome image is formed on the sheet of paper, and this sheet of paper on which the color image or monochrome image has been formed is then ejected from apparatus body 2.

Figure 3:
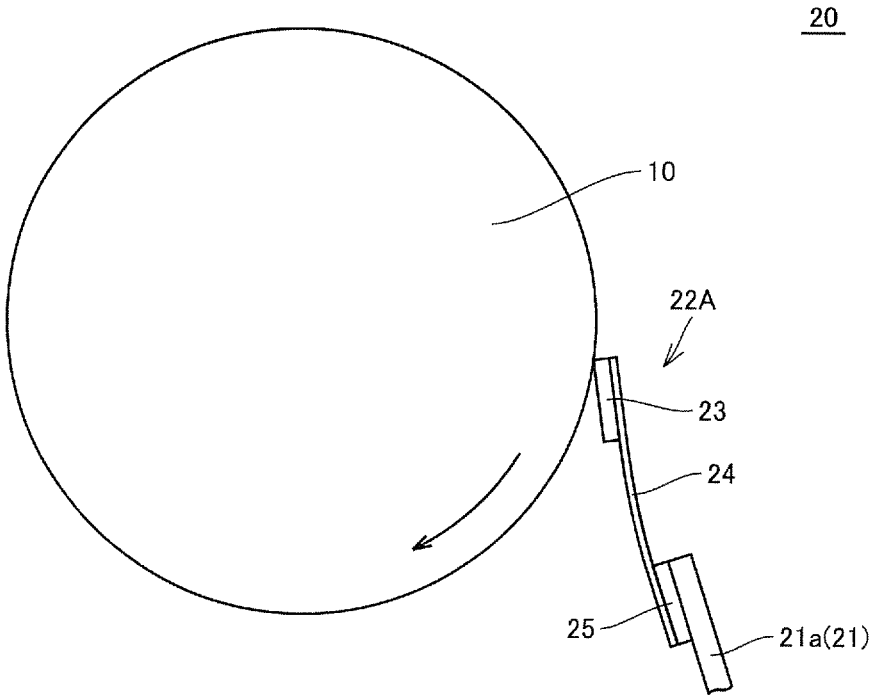
FIG. 3 is a schematic enlarged view of a substantial part of a cleaning device shown in FIG. 2 and the vicinity thereof.
Figure 4A:
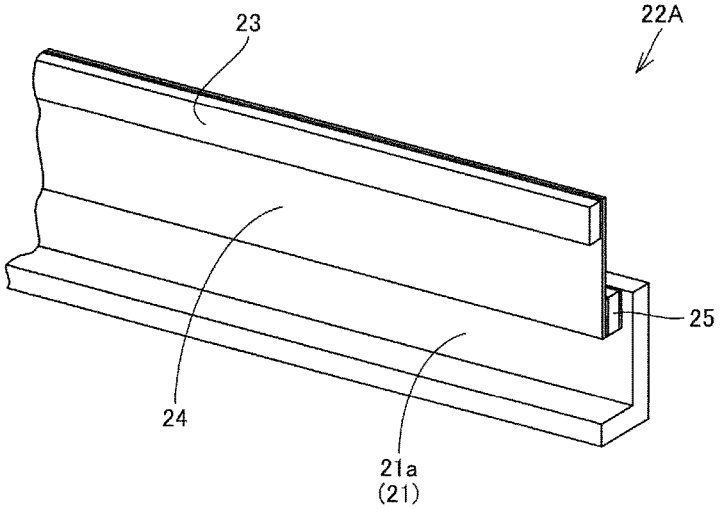
FIG. 4A is a schematic perspective view of a subassembly including a tip blade shown in FIG. 3 and a support frame to which this tip blade has been fixed.
Figure 4B:
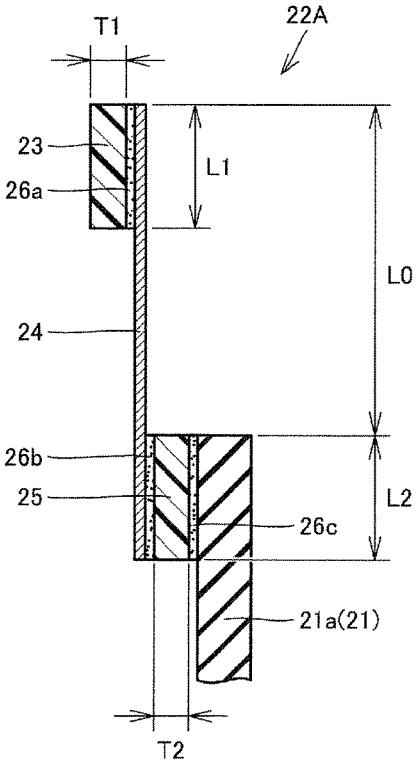
FIG. 4B is a schematic sectional view of the subassembly including the tip blade shown in FIG. 3 and the support frame to which this tip blade has been fixed.

FIG. 3 is a schematic enlarged view of a substantial part of the cleaning device shown in FIG. 2 and the vicinity thereof. FIGS. 4A and 4B are diagrams showing the configuration of a subassembly including a tip blade shown in FIG. 3 and a support frame to which this tip blade has been fixed. FIG. 4A is a schematic perspective view of this subassembly, and FIG. 4B is a schematic sectional view of this subassembly. Referring to these FIGS. 3, 4A and 4B, the details of a cleaning device 20 will be described below.

It is noted that since the aforementioned image forming units 4Y, 4M, 4C and 4K basically have the same configuration, a distinction will not be particularly made hereafter among photoreceptor drums 10Y, 10M, 10C, 10K and cleaning devices 20Y, 20M, 20C, 20K included in these image forming units 4Y, 4M, 4C, 4K. They will be represented simply as "photoreceptor drum 10" and "cleaning device 20" and described.

As shown in FIGS. 3, 4A and 4B, cleaning device 20 includes a support frame 21*a* serving as a support portion which is part of a casing 21 containing the toner that has been collected by being scraped off and removed, and a tip blade 22A mounted on support frame 21*a*. Tip blade 22A has an outer shape of an elongated, substantially flat plate located to extend along an axial direction of photoreceptor drum 10, and is arranged such that the tip of a cleaning member 23 is in contact with the surface of photoreceptor drum 10 (see FIG. 3).

Tip blade 22A mainly has cleaning member 23, a leaf spring member 24, and a cushioning member 25. Cleaning member 23 is fixed to leaf spring member 24, and leaf spring member 24 is fixed to support frame 21*a* with cushioning member 25 interposed therebetween.

Cleaning member 23 is formed of an elastic body having a prescribed thickness, and is made of, for example, a rubber material such as urethane rubber. Here, tip blade 22A is for bringing cleaning member 23 into contact with photoreceptor drum 10 by elastic deformation of leaf spring member 24 which will be described later. Thus, in contrast to rubber materials used for conventional rubber blades, as cleaning member 23, fluorine rubber (FKM), styrene-butadiene rubber (SBR), acrylonitrile rubber (NBR) or the like can be used instead of the aforementioned urethane rubber, and even a rubber material having high abrasion resistance or high ozone resistance can be used.

Leaf spring member 24 is formed of a metallic member having a prescribed thickness, and is formed of, for example, a plate-like member made of stainless steel, phosphor bronze or the like having high corrosion resistance. It is particularly preferred to use a plate-like member made of stainless steel which has high strength and is less likely to suffer from metal fatigue as leaf spring member 24. It is noted that in a situation where leaf spring member 24 is formed of a plate-like member made of stainless steel, it is preferred for leaf spring member 24 to have a thickness of not less than 0.03 mm and not more than 0.10 mm in order to improve the capability of tip blade 22A to follow photoreceptor drum 10.

Cushioning member 25 is formed of an elastic body having a prescribed thickness, and is made of, for example, a rubber material such as urethane rubber. Here, tip blade 22A is for bringing cleaning member 23 into contact with photoreceptor drum 10 by elastic deformation of leaf spring member 24 which will be described later. Thus, in contrast to rubber materials used for conventional rubber blades, as cleaning member 23, fluorine rubber (FKM), styrene-butadiene rubber (SBR), acrylonitrile rubber (NBR) or the like can be used instead of the aforementioned urethane rubber, and even a rubber material having high ozone resistance can be used.

Cleaning member 23 is fixed by an adhesive to one end of leaf spring member 24 in a direction orthogonal to the axial direction of photoreceptor drum 10. Thus, as shown in FIG. 4B, an adhesive layer 26*a* is located between cleaning member 23 and the aforementioned one end of leaf spring member 24. A thermoplastic hot melt adhesive, for example, can be suitably employed as the adhesive used to fix cleaning member 23 to leaf spring member 24.

The other end of leaf spring member 24 opposite to the aforementioned one end is fixed to cushioning member 25 by an adhesive. Thus, as shown in FIG. 4B, an adhesive layer 26*b* is located between the aforementioned other end of leaf spring member 24 and cushioning member 25. A thermoplastic hot melt adhesive, for example, can be suitably employed as the adhesive used to fix leaf spring member 24 to cushioning member 25. It is noted that adhesive layer 26*b* is preferably provided over the entire cushioning member 25 in a longitudinal direction.

Here, in one or more embodiments, one of a pair of main surfaces of leaf spring member 24, which is different from the main surface affixed to cleaning member 23, is affixed to cushioning member 25. Thus, cleaning member 23 is fixed to the main surface of leaf spring member 24 opposite to the main surface of leaf spring member 24 facing cushioning member 25.

Cushioning member 25 is fixed to support frame 21*a* by an adhesive. Thus, as shown in FIG. 4B, an adhesive layer 26*c* is located between cushioning member 25 and support frame 21*a*. A thermoplastic hot melt adhesive, for example, can be suitably employed as the adhesive used to fix cushioning member 25 to support frame 21*a*.

As described above, in cleaning device 20, cleaning member 23 is fixed to leaf spring member 24, and leaf spring member 24 is fixed to support frame 21*a* with cushioning member 25 interposed therebetween. That is, cushioning member 25 has one main surface fixed to leaf spring member 24 via adhesive layer 26*b* and the other main surface fixed to support frame 21*a* via adhesive layer 26*c*, whereby tip blade 22A is mounted on support frame 21*a*.

Here, leaf spring member 24 of tip blade 22A is elastically deformed by appropriate adjustment of the position where support frame 21*a* is provided relative to photoreceptor drum 10. A restoring force of this elastically deformed leaf spring member 24 causes the tip of cleaning member 23 to come into contact with the surface of photoreceptor drum 10 at a prescribed contact pressure.

With the configuration as described above, too, it is inevitable that adhesive layer 26*b* between leaf spring member 24 and cushioning member 25 will have a non-uniform thickness as long as leaf spring member 24 is fixed to cushioning member 25 by an adhesive. This causes the actual free length of tip blade 22A to vary depending on the location in the axial direction of photoreceptor drum 10.

However, since leaf spring member 24 is fixed to support frame 21*a* with cushioning member 25 interposed therebetween, variation in the contact pressure of cleaning member 23 with photoreceptor drum 10 depending on the location in the axial direction of photoreceptor drum 10, which is caused by the aforementioned variation in the actual free length of tip blade 22A, is absorbed by this elastically deformed cushioning member 25.

Accordingly, by employing the configuration such as described herein, the contact pressure of cleaning member 23 with photoreceptor drum 10 in each location in the axial direction of photoreceptor drum 10 can be made more uniform, thus suppressing the occurrence of abrasion variation in the photoreceptor film formed on the surface of photoreceptor drum 10. As a result, not only a reduction in quality of a formed image can be suppressed, but also the contact pressure of tip blade 22A with photoreceptor drum 10 can be set at a sufficiently low level, thereby increasing the life of photoreceptor drum 10.

Here, although the hardness of the elastic body forming cushioning member 25 is not particularly limited, an elastic body having an Asker C hardness of not less than 50 degrees and not more than 80 degrees may be suitably used. The occurrence of abrasion variation in the photoreceptor film formed on the surface of photoreceptor drum 10 can thereby be suppressed appropriately.

The thickness and length of cleaning member 23 (a thickness T1 and a length L1 shown in FIG. 4B) are not particularly limited. The thickness is set to not less than 1.5 mm and not more than 2.0 mm, for example, and the length is set to 6.0 mm, for example.

Although the thickness of cushioning member 25 (a thickness T2 shown in FIG. 4B) is not particularly limited, either, the thickness is suitably set to not less than 1.5 mm and not more than 2.0 mm. The occurrence of abrasion variation in the photoreceptor film formed on the surface of photoreceptor drum 10 can thereby be suppressed appropriately.

The length of cushioning member 25 (a length L2 shown in FIG. 4B) is not particularly limited. The length is set to not less than 3.0 mm and not more than 5.0 mm, for example.

Further, although the length between the tip of the aforementioned one end of leaf spring member 24 fixed to cleaning member 23 and an end portion, which is closer to the aforementioned one end, of the aforementioned other end of leaf spring member 24 fixed to cushioning member 25 (that is, a design free length L0 shown in FIG. 4B) is not particularly limited, either, the design free length is suitably set to not less than 12.0 mm and not more than 14.0 mm. The occurrence of abrasion variation in the photoreceptor film formed on the surface of photoreceptor drum 10 can thereby be suppressed appropriately.

Here, in order to develop a sufficient elastic biasing force at leaf spring member 24, the design free length may be made longer than the length of cleaning member 23.

It is noted that with regard to the hardness and dimensions described above, the suitable ranges of the hardness and thickness of cushioning member 25 and of the design free length of tip blade 22A were all derived based on a second verification test which will be described later.

(Modification)

Figure 5A:
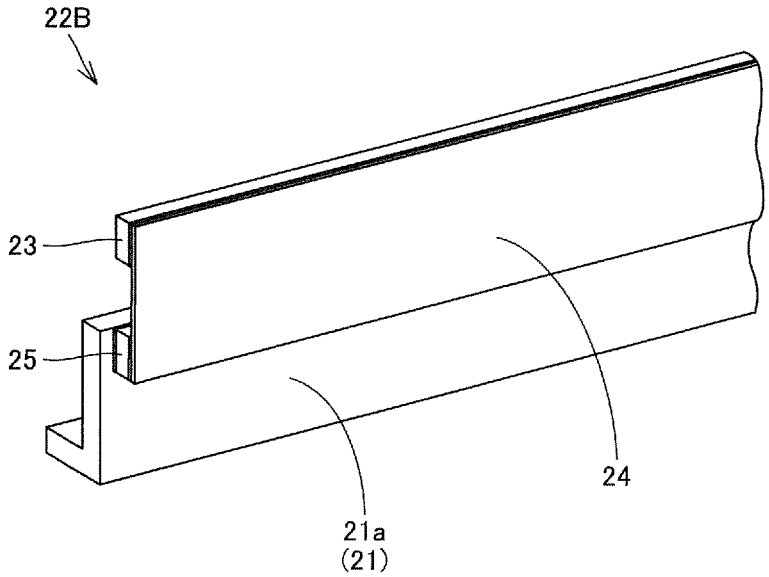
FIG. 5A is a schematic perspective view of a subassembly including a tip blade according to a modification and a support frame to which this tip blade has been fixed.
Figure 5B:
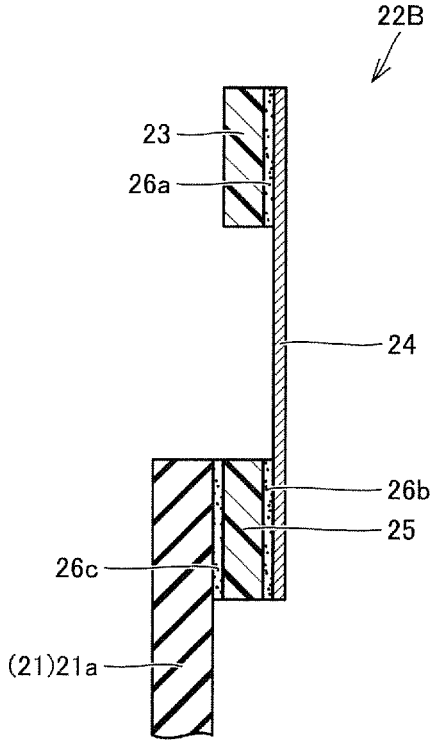
FIG. 5B is a schematic sectional view of the subassembly including the tip blade according to the modification and the support frame to which this tip blade has been fixed.

FIGS. 5A and 5B are diagrams showing the configuration of a subassembly including a tip blade according to a modification based on the embodiments of the present invention described above and a support frame to which this tip blade has been fixed. FIG. 5A is a schematic perspective view of this subassembly, and FIG. 5B is a schematic sectional view of this subassembly. Referring to these FIGS. 5A and 5B, the details of a cleaning device according to the present modification will be described below.

As shown in FIGS. 5A and 5B, when compared to cleaning device 20 in the embodiments of the present invention described above, the cleaning device according to the present modification is only different in that it includes a tip blade 22B having a different configuration instead of tip blade 22A. Tip blade 22B mainly has cleaning member 23, leaf spring member 24 and cushioning member 25 as with tip blade 22A, but is different from tip blade 22A in the position where cushioning member 25 is attached.

Specifically, in the present modification, one of the pair of main surfaces of leaf spring member 24, which is affixed to cleaning member 23, is affixed to cushioning member 25. Thus, cleaning member 23 is fixed to the main surface of leaf spring member 24 facing cushioning member 25. It is noted that adhesive layer 26*b* is located between leaf spring member 24 and cushioning member 25, and adhesive layer 26*c* is located between cushioning member 25 and support frame 21*a*.

With such configuration, too, a similar effect to that described above in the embodiments of the present invention can be produced, thus suppressing the occurrence of abrasion variation in the photoreceptor film formed on the surface of photoreceptor drum 10. As a result, not only a reduction in quality of a formed image can be suppressed, but also the contact pressure of tip blade 22B with photoreceptor drum 10 can be set at a sufficiently low level, thereby increasing the life of photoreceptor drum 10.

(Verification Tests)

The following describes in detail verification tests, in which the cleaning devices according to one or more embodiments of the present invention and the modification based thereon described above were actually fabricated, and performance difference that occurred between these cleaning devices and conventional cleaning devices was determined.

Figure 6A:
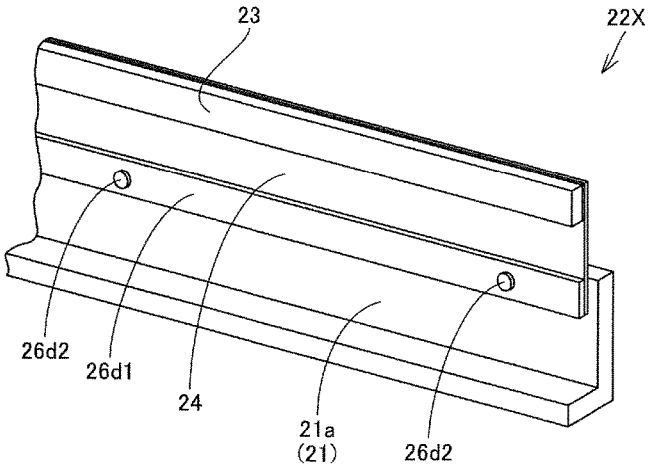
FIG.6A PRIOR ART
FIG. 6A is a schematic perspective view of a subassembly including a tip blade according to Comparative Example 1 and a support frame to which this tip blade has been fixed.
Figure 6B:
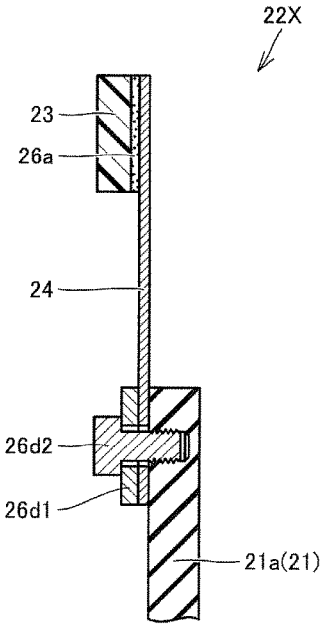
FIG.6B PRIOR ART
FIG. 6B is a schematic sectional view of the subassembly including the tip blade according to Comparative Example 1 and the support frame to which this tip blade has been fixed.
Figure 7A:
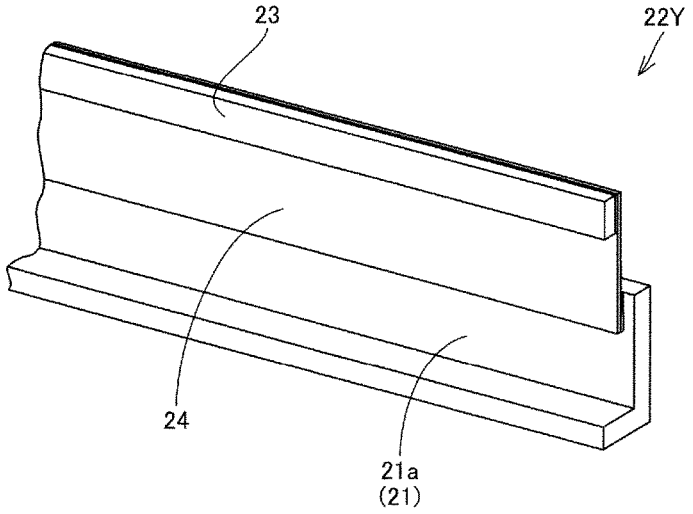
FIG.7A PRIOR ART
FIG. 7A is a schematic perspective view of a subassembly including a tip blade according to Comparative Example 2 and a support frame to which this tip blade has been fixed.
Figure 7B:
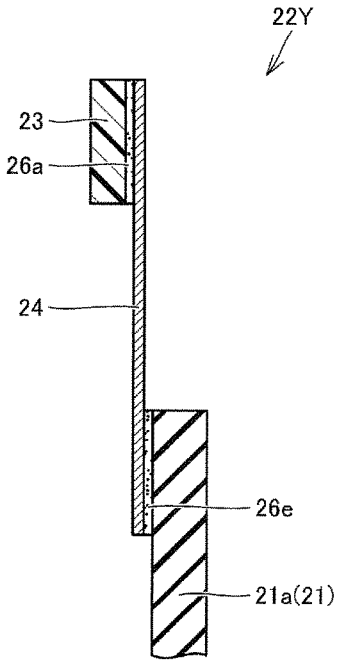
FIG.7B PRIOR ART
FIG. 7B is a schematic sectional view of the subassembly including the tip blade according to Comparative Example 2 and the support frame to which this tip blade has been fixed.

Prior to description of the details of the verification tests, the conventional cleaning devices that were used in the verification tests are described. FIGS. 6A and 6B are diagrams showing the configuration of a subassembly including a tip blade of a cleaning device according to Comparative Example 1 as a conventional example and a support frame to which this tip blade has been fixed. FIG. 6A is a schematic perspective view of this subassembly, and FIG. 6B is a schematic sectional view of this subassembly. FIGS. 7A and 7B are diagrams showing the configuration of a subassembly including a tip blade of a cleaning device according to Comparative Example 2 as a conventional example and a support frame to which this tip blade has been fixed. FIG. 7A is a schematic perspective view of this subassembly, and FIG. 7B is a schematic sectional view of this subassembly.

As shown in FIGS. 6A and 6B, a tip blade 22X of the cleaning device according to Comparative Example 1 does not include the aforementioned cushioning member 25, and the aforementioned other end of leaf spring member 24 is fixed to support frame 21*a* by a screw 26*d*2 via a pad member 26*d*1. It is noted that screw 26*d*2 is screwed at three locations, which are a right end position, a central position and a left end position along the axial direction of the photoreceptor drum.

As shown in FIGS. 7A and 7B, on the other hand, a tip blade 22Y of the cleaning device according to Comparative Example 2 does not include the aforementioned cushioning member 25, and the aforementioned other end of leaf spring member 24 is fixed to support frame 21*a* by an adhesive. Thus, in this tip blade 22Y, an adhesive layer 26*e* is provided at a position between the aforementioned other end of leaf spring member 24 and support frame 21*a*.

Figure 8:
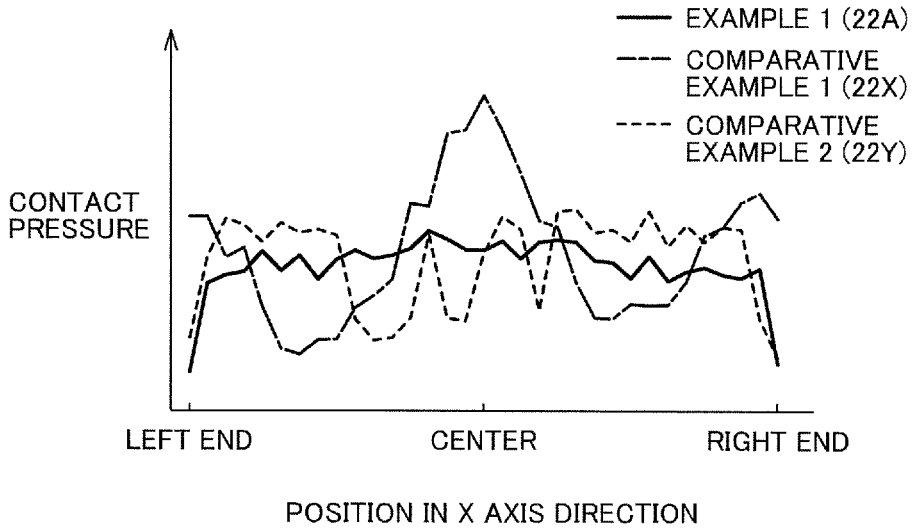
FIG. 8 is a graph showing test results of a first verification test.

In the first verification test, the cleaning device in the embodiments of the present invention described above (that is, the cleaning device including tip blade 22A) was prepared as Example 1, and the cleaning device according to Comparative Example 1 described above (that is, the cleaning device including tip blade 22X) and the cleaning device according to Comparative Example 2 described above (that is, the cleaning device including tip blade 22Y) were prepared. Then, in order to verify the variation in the contact pressure of the cleaning member with the photoreceptor drum depending on the location in the axial direction of the photoreceptor drum for each of these cleaning devices, the contact pressure was actually measured when a constant displacement was applied to the tip of the cleaning member at a pitch of 10 mm along the aforementioned direction. FIG. 8 is a graph showing test results of this first verification test.

It is noted that the dimensions of each portion and the hardness of the cushioning member in the cleaning devices according to Example 1 and Comparative Examples 1 and 2 prepared in the first verification test (only Example 1 includes the cushioning member) are the same as those of the cleaning devices according to Example 1 and Comparative Examples 1 and 2 prepared in the second verification test which will be described later, the details of which are shown in FIG. 9.

As shown in FIG. 8, in the cleaning device according to Comparative Example 1, the contact pressure increased greatly in the vicinity of the screwed locations and decreased greatly in positions away from the screwed locations, which caused great variation in the contact pressure to occur at the tip of the cleaning member depending on the location in the axial direction of the photoreceptor drum. This is because, in the configuration of the cleaning device according to Comparative Example 1, it was inevitable that the contact pressure of tip blade 22X with the support portion would be distributed non-uniformly, which resulted in variation in the actual free length of tip blade 22X depending on the location in the axial direction of the photoreceptor.

In the cleaning device according to Comparative Example 2, on the other hand, although not to the extent of the cleaning device according to Comparative Example 1, the result was that considerable variation in the contact pressure occurred at the tip of the cleaning member depending on the location in the axial direction of the photoreceptor drum. This is because, in the configuration of the cleaning device according to Comparative Example 2, it was inevitable that adhesive layer 26*e* between tip blade 22X and the support portion would have a non-uniform thickness, which resulted in variation in the actual free length of tip blade 22Y depending on the location in the axial direction of the photoreceptor.

In contrast, in the cleaning device according to Example 1, it was confirmed that the variation in the contact pressure that occurred at the tip of the cleaning member depending on the location in the axial direction of the photoreceptor drum was greatly suppressed as compared to the cleaning devices according to Comparative Example 1 and Comparative Example 2, which led to a more uniform contact pressure of the cleaning member with the photoreceptor drum in each location in the axial direction of the photoreceptor drum. It is noted that the contact pressure variation excluding both ends in the axial direction of the photoreceptor drum in the cleaning device according to Example 1 was about ⅕ of the contact pressure variation in the cleaning device according to Comparative Example 1, and about ⅖ of the contact pressure variation in the cleaning device according to Comparative Example 2.

In the second verification test, in addition to the cleaning devices according to Example 1 and Comparative Examples 1 and 2 described above, the cleaning device according to the modification based on the embodiments of the present invention described above (that is, the cleaning device including tip blade 22B) was prepared as Example 2, and furthermore, cleaning devices having changed dimensions of each portion and changed hardness of the cushioning member from those of the cleaning device were prepared as Examples 3 to 8. Then, image forming apparatuses including these cleaning devices, respectively, were fabricated, and the life of the photoreceptor drum was actually determined. FIG. 9 is a table showing test conditions and test results of this second verification test.

Here, the dimensions of each portion and the hardness of the cushioning member in the cleaning devices according to Examples 1 to 8 and Comparative Examples 1 and 2 prepared in the second verification test (only Examples 1 to 8 include the cushioning member) are as shown in FIG. 9.

In this second verification test, image formation (namely, printing) was repeatedly performed for each of the image forming apparatuses including the cleaning devices according to Examples 1 to 8 and Comparative Examples 1 and 2, and it was determined whether or not an unacceptable printing failure occurred in the formed image before a predetermined set life was reached. In this evaluation, a situation where an unacceptable printing failure occurred before the set life was reached was judged as "disapproved," while a situation where an unacceptable printing failure did not occur before the set life was reached was judged as "good."

As shown in FIG. 9, the evaluation result was "good" for all of the image forming apparatuses including the cleaning devices according to Examples 1 to 8, which confirmed that the predetermined set life could be realized. On the other hand, the evaluation result was "disapproved" for both of the image forming apparatuses including the cleaning devices according to Comparative Examples 1 and 2, which confirmed that the predetermined set life could not be realized.

From the above results of the first verification test and the second verification test, it was also experimentally confirmed that, with the cleaning devices and the image forming apparatuses including the same according to one or more embodiments of the present invention and their modification described above, the occurrence of abrasion variation in the photoreceptor film could be suppressed, so that not only a reduction in quality of a formed image could be suppressed, but also the contact pressure of the tip blade with the photoreceptor could be set at a sufficiently low level, thereby increasing the life of the photoreceptor.

Although the embodiments of the present invention and their modification described above have illustrated and discussed the cases where the cushioning member is fixed to the support frame as a support portion by an adhesive, this portion can be fixed with another fixation method. In that case, too, the aforementioned effect will be produced so long as the leaf spring member is fixed to the support frame with the cushioning member interposed therebetween.

Although the embodiments of the present invention and their modification described above have illustrated and discussed the cases where the present invention is applied to a so-called tandem type color printer based on electrophotography and a cleaning device included therein, the applications of the present invention are not limited as such, and the present invention is applicable to various types of image forming apparatuses based on electrophotography and cleaning devices included therein.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A cleaning device comprising:

a cleaning member formed of an elastic body that scrapes off and removes toner that has adhered to a surface of a rotating photoreceptor;

a leaf spring member that presses the cleaning member against the surface of the photoreceptor; and a support portion that supports the leaf spring member, wherein the cleaning member is fixed to one end of the leaf spring member, the other end of the leaf spring member is fixed to the support portion with a cushioning member formed of an elastic body interposed therebetween, the cushioning member is fixed to the other end of the leaf spring member by an adhesive, and is fixed to the support portion by an adhesive, the cushioning member has an Asker C hardness of not less than 50 degrees and not more than 80 degrees, and the leaf spring member includes a portion where the cleaning member and the support portion do not overlap, satisfying Equation 1:

$$L0>L1 \quad (1)$$

where L0 is a design free length of the leaf spring member and L1 is a length of the cleaning member.

2. The cleaning device according to claim 1, wherein the cleaning member is fixed to the one end of the leaf spring member by an adhesive.

3. The cleaning device according to claim 1, wherein the cleaning member is fixed to a main surface of the leaf spring member opposite to a main surface of the leaf spring member facing the cushioning member.

4. The cleaning device according to claim 1, wherein the cleaning member is fixed to a main surface of the leaf spring member facing the cushioning member.

5. An image forming apparatus comprising the cleaning device according to claim 1.

6. The cleaning device according to claim 1, wherein the leaf spring member includes a portion where the cleaning member and the support portion do not overlap, further satisfying Equation 2:

$$L1>L2 \quad (2)$$

where L1 is a length of the cleaning member and L2 is a length of the cushioning member L2.

* * * * *